US007032535B2

(12) United States Patent
Halstead et al.

(10) Patent No.: US 7,032,535 B2
(45) Date of Patent: Apr. 25, 2006

(54) TRACKING DEVICE AND METHOD

(76) Inventors: David Halstead, 10411 26th St., Rancho Cucomonga, CA (US) 91729; Kenneth T. Stump, 15201 Triton, La., Huntington Beach, CA (US) 92649

( * ) Notice: Subject to any disclaimer, the term of this patent is extended or adjusted under 35 U.S.C. 154(b) by 368 days.

(21) Appl. No.: 10/342,485

(22) Filed: Jan. 15, 2003

(65) Prior Publication Data

US 2003/0131781 A1 Jul. 17, 2003

Related U.S. Application Data

(60) Provisional application No. 60/348,740, filed on Jan. 15, 2002.

(51) Int. Cl.
*G09F 9/00* (2006.01)

(52) U.S. Cl. ..... 116/308; 116/DIG. 1

(58) Field of Classification Search ..... 116/308, 116/327, 298, 306–307, DIG. 1; 283/72, 283/81, 62, 117, 900, 74, 101; 40/310–311, 40/111, 113

See application file for complete search history.

(56) References Cited

U.S. PATENT DOCUMENTS

| | | | | |
|---|---|---|---|---|
| 2,833,064 A | | 5/1958 | Parker | |
| 3,706,626 A | * | 12/1972 | Smith et al. | 428/42.3 |
| 3,921,568 A | * | 11/1975 | Fish | 116/308 |
| 4,345,541 A | * | 8/1982 | Villa-Real | 116/308 |
| 4,752,087 A | | 6/1988 | Weisbach | |
| 4,913,083 A | * | 4/1990 | Valvo et al. | 116/308 |
| 5,011,032 A | * | 4/1991 | Rollman | 215/230 |
| 5,216,975 A | * | 6/1993 | Bartholomew | 116/324 |
| 5,386,795 A | * | 2/1995 | Bartholomew | 116/308 |
| 5,577,335 A | | 11/1996 | Tucker | |
| 5,720,392 A | | 2/1998 | Price | |
| 5,881,597 A | | 3/1999 | Brooks | |
| 5,979,698 A | | 11/1999 | Deal | |
| D420,744 S | | 2/2000 | Ostgaard et al. | |
| 6,152,067 A | | 11/2000 | Mathison | |
| 2003/0122370 A1 | * | 7/2003 | Goddard | 283/81 |

* cited by examiner

*Primary Examiner*—R. Alexander Smith
(74) *Attorney, Agent, or Firm*—Eric Karich

(57) ABSTRACT

A tracking device for tracking the ingestion of a plurality of doses of an ingestible material from a container has a time indicating sheet and a plurality of dose indicators. A plurality of time indicating indicia is imprinted on a top surface of the time indicating sheet, each of the plurality of time indicating indicia being spatially separated from each other on the top surface and being adapted to indicate a time period. The plurality of dose indicators each have printed on an upper surface one of a plurality of dose identifying indicia and a reference mark that indicates a direction of orientation visible on each of the plurality of dose indicators. A layer of adhesive on a lower surface of the plurality of dose indicators allows the plurality of does indicators to be attached to the top surface of the time indicating sheet such that the reference mark visibly indicates a direction of orientation that is associated with one of the plurality of time indicating indicia.

13 Claims, 6 Drawing Sheets

TRACKING DEVICE AND METHOD

CROSS-REFERENCE TO RELATED APPLICATIONS

This application for a utility patent claims the benefit of U.S. Provisional Application No. 60/348,740, filed Jan. 15, 2002. This application is incorporated herein by reference in its entirety.

STATEMENT REGARDING FEDERALLY SPONSORED RESEARCH

Not Applicable

BACKGROUND OF THE INVENTION

1. Field of the Invention

This invention relates generally to devices for tracking the ingestion of in ingestible materials, and more particularly to a tracking device that can be attached to a container of the ingestible material for tracking a patient's consumption of dosages of a medication.

2. Description of Related Art

The following art defines the present state of this field:

Several patent references disclose medication tracking devices that include adhesive tapes or labels that are adapted to be adhesively attached to a bottle of medication, and then peeled from the bottle to track doses of medication consumed. Examples include the following:

Deal, U.S. Pat. No. 5,979,698, teaches a means for recording medication doses using a strip that is adhesively attached to the bottle of medication. A tab is slidably attached to the strip. The tab's position relative to a plurality of detents or other form of indicia is used to track doses of medication that have been taken.

Weisbach, U.S. Pat. No. 4,752,087, teaches a medication record-keeping indicia device that includes a label that includes a plurality of indicia printed thereupon. A removable mask or coating is used to cover the indicia; and the user indicates taking a dose of medication by removing the mask or coating.

Brooks, U.S. Pat. No. 5,881,597, teaches a method of using a consumption indicator label apparatus. The apparatus includes a plurality of tab members that are adhesively attached to a container. By peeling the tab members from the container, the user is able to indicate the dosage taken.

Parker, U.S. Pat. No. 2,833,064, teaches a recording and reminding device that includes a strip that includes a plurality of tabs. Tearing the tabs from the strip provides a method of tracking medication dosage.

Another set of prior art references teach the attachment of a clock face to a bottle of medication for tracking dosage, including the following:

Price, U.S. Pat. No. 5,720,392, teaches a prescription timer that includes a clock face that is attached to the cap of a bottle of medication. The clock face includes an hour hand that can be rotated to indicate the time that medication has been taken, and when the next medication should be taken.

Additional references that include similar clock faces on a bottle of medication include Mathison, U.S. Pat. No. 6,152,067, and Tucker, U.S. Pat. No. 5,577,335. An additional invention used to track dosage is described in Barker, EP Publication 0381494.

The above-described references are hereby incorporated by reference in full.

The prior art teaches various medication tracking devices that include adhesive tapes or labels that are adapted to be adhesively attached to a bottle of medication, and then peeled from the bottle to track doses of medication consumed. The prior art also teaches the attachment of a clock face to a bottle of medication for tracking dosages of medication. However, the prior art does not teach the association of a time indicating sheet such as a clock face with a bottle of medication, then sequentially sticking a plurality of dose indicators to the time indicating sheet, and indicating when dosages are taken by the placement and orientation of the dose indicators on the time indicating sheet. The present invention fulfills these needs and provides further related advantages as described in the following summary.

SUMMARY OF THE INVENTION

The present invention teaches certain benefits in construction and use which give rise to the objectives described below.

The present invention provides a tracking device for tracking the ingestion of a plurality of doses of an ingestible material from a container. The tracking device includes a time indicating sheet having a top surface and a bottom surface; a plurality of time indicating indicia imprinted on the top surface, each of the plurality of time indicating indicia being spatially separated from each other on the top surface and being adapted to indicate a time period; a plurality of dose indicators, each of the plurality of dose indicators having one of a plurality of dose identifying indicia; a means for visibly indicating a direction of orientation visible on each of the plurality of dose indicators; and a means for attaching each of the plurality of dose indicators, in turn, to the top surface of the time indicating sheet such that the means for visibly indicating a direction of orientation visibly indicates a direction of orientation that is associated with one of the plurality of time indicating indicia.

A primary objective of the present invention is to provide a tracking device having advantages not taught by the prior art.

Another objective is to provide a time indicating sheet and a plurality of dose indicators that together can be used to indicate when dosages are taken by the placement and orientation of the dose indicators on the time indicating sheet.

A further objective is to provide a tracking device that is inexpensive to manufacture and simple to use.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above-described drawing figures illustrate the invention, a tracking device 10 for tracking the ingestion of a plurality of doses of an ingestible material from a container 12. The tracking device 10 is typically used to track doses of medication, although it could also be used to track the use of other materials.

Figure 1:
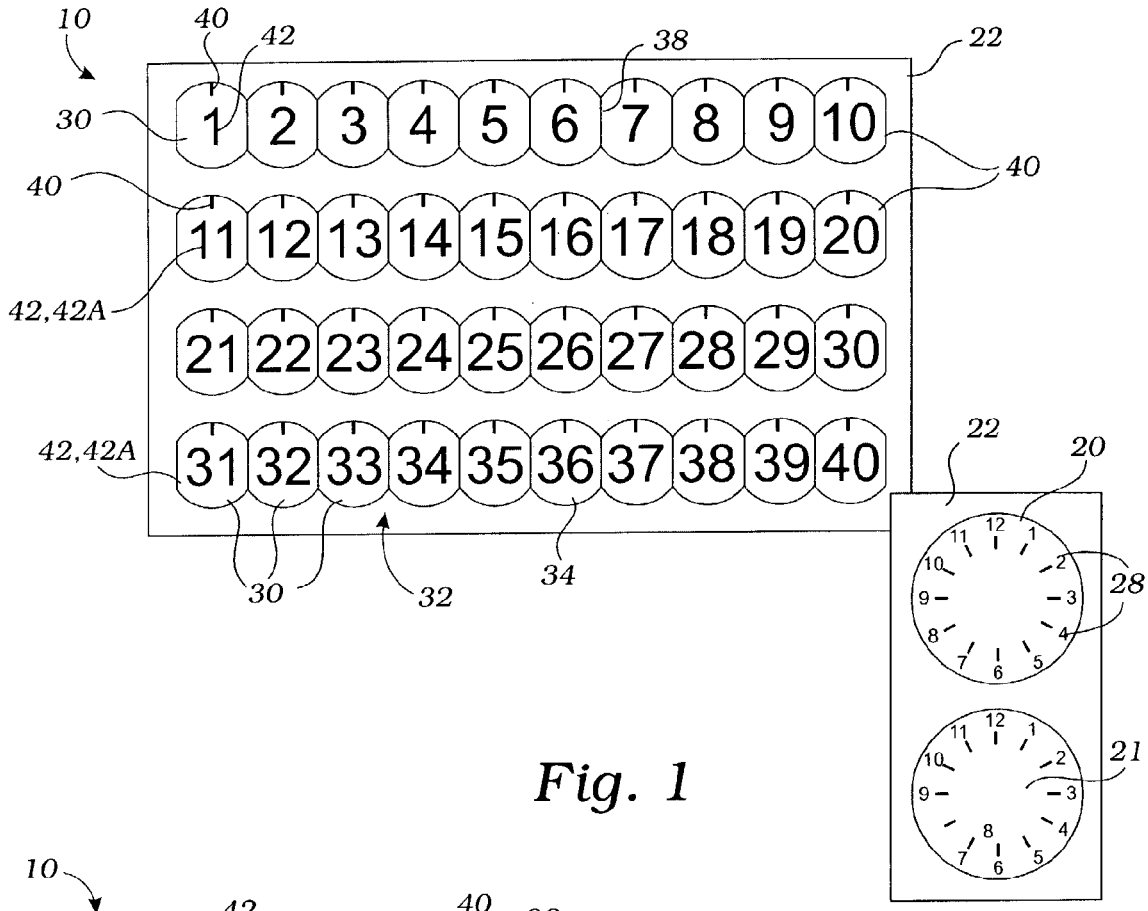
FIG. 1 is a top plan view of a first embodiment of the present invention, a tracking device for tracking the ingestion of a plurality of doses of an ingestible material, the tracking device including a time indicating sheet and an ingestion tracking strip.
Figure 3:
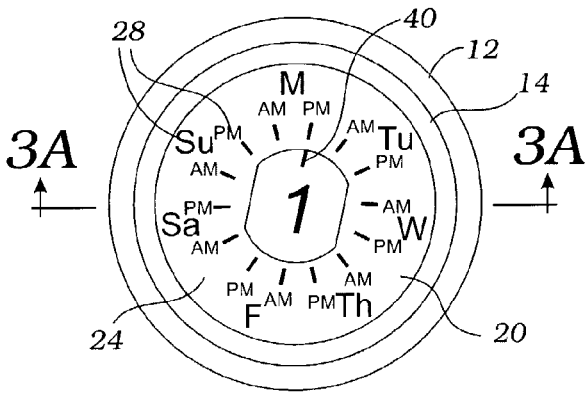
FIG. 3 is a top plan view of an alternative embodiment of the time indicating sheet illustrating how the time indicating sheet is positioned on a lid of a container.
Figure 7:
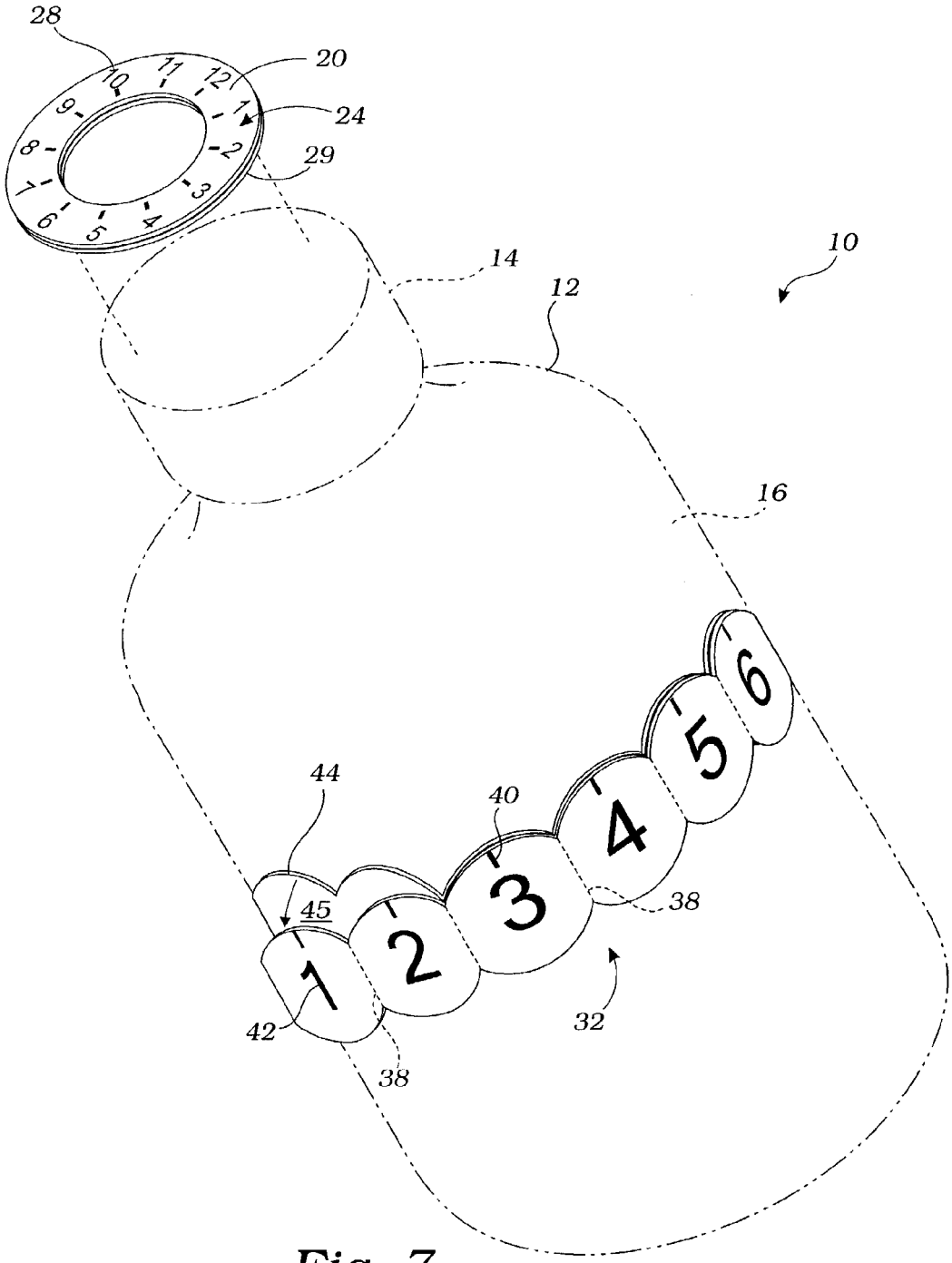
FIG. 7 is a partially exploded perspective view of the container illustrating how both the time indicating sheet and the ingestion tracking strip are attached to the container in the preferred embodiment.
Figure 8:
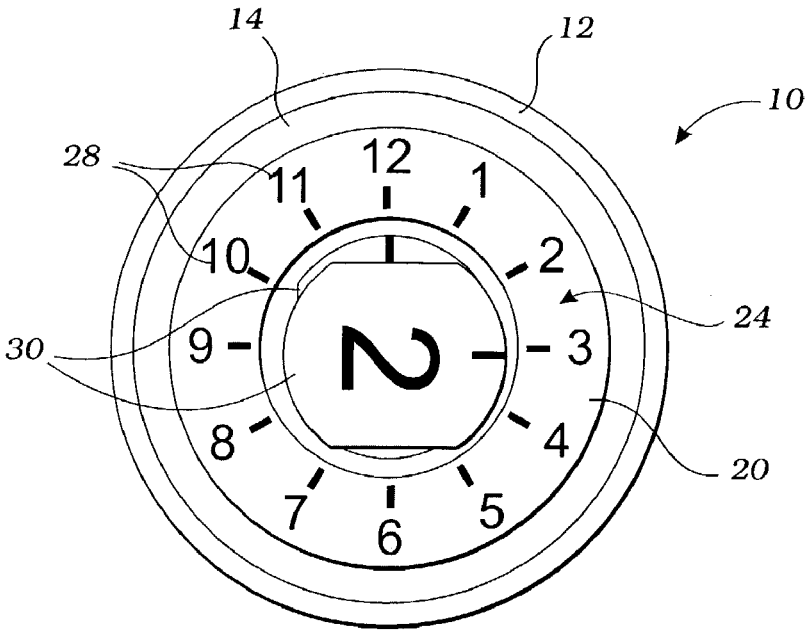
FIG. 8 is a top plan view of the lid of the container illustrating how the discrete units are attached to the time indicating sheet to indicate the time at which the doses were taken.
Figure 9:
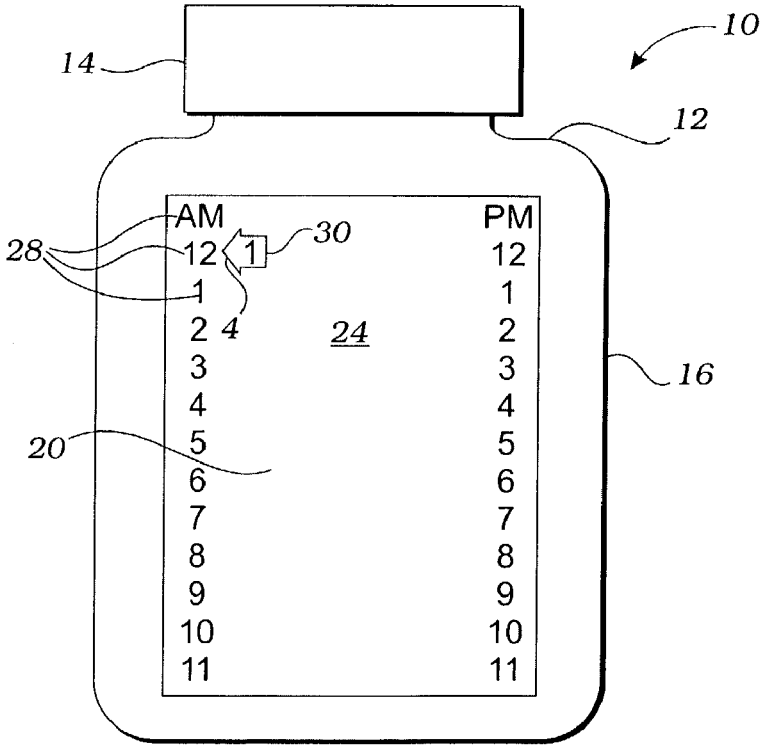
FIG. 9 is a side elevational view of the container illustrating how the discrete unit us attached to a second embodiment of the time indicating sheet.

As shown in FIG. 1, the tracking device 10 includes a time indicating sheet 20 and a plurality of dose indicators 30 that together may be used to track which doses of medication have been ingested, and at what times they were taken. The time indicating sheet 20 and the plurality of dose indicators 30 are adapted to be associated with the container 12, as shown in FIG. 7. As shown in FIGS. 3, 8, and 9, when a dose is consumed, one of a plurality of dose indicators 30 is attached to the time indicating sheet 20 to indicate by its placement that the one of the plurality of doses has been ingested, and by its position and orientation the time at which the dose was taken.

Figure 6:
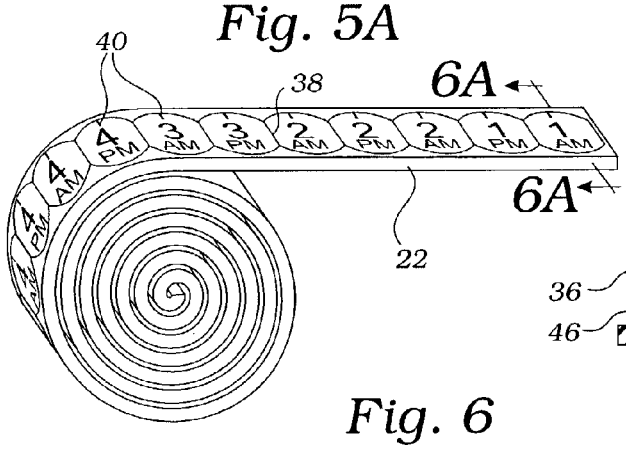
FIG. 6 is a perspective view of a third embodiment of the ingestion tracking strip.
Figure 6A:
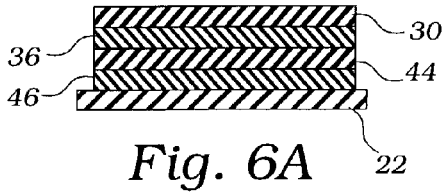
FIG. 6A is a sectional view thereof taken along line 6A—6A in FIG. 6.

As shown in FIG. 1, in the preferred embodiment the time indicating sheet 20 and the plurality of dose indicators 30 are preferably paper sheets that are mounted on a release liner 22. As is well known in the art, the release liner 22 has a release liner surface 23 that is easily separated from adhesives, such as a waxy or plastic surface. The release liner 22 may be in two sheets, as shown in FIG. 1, a single sheet, as shown in FIG. 2, a roll as shown in FIGS. 6 and 6A, or any other embodiment that may be convenient for the use of the tracking device 10 by the consumer.

Figure 2:
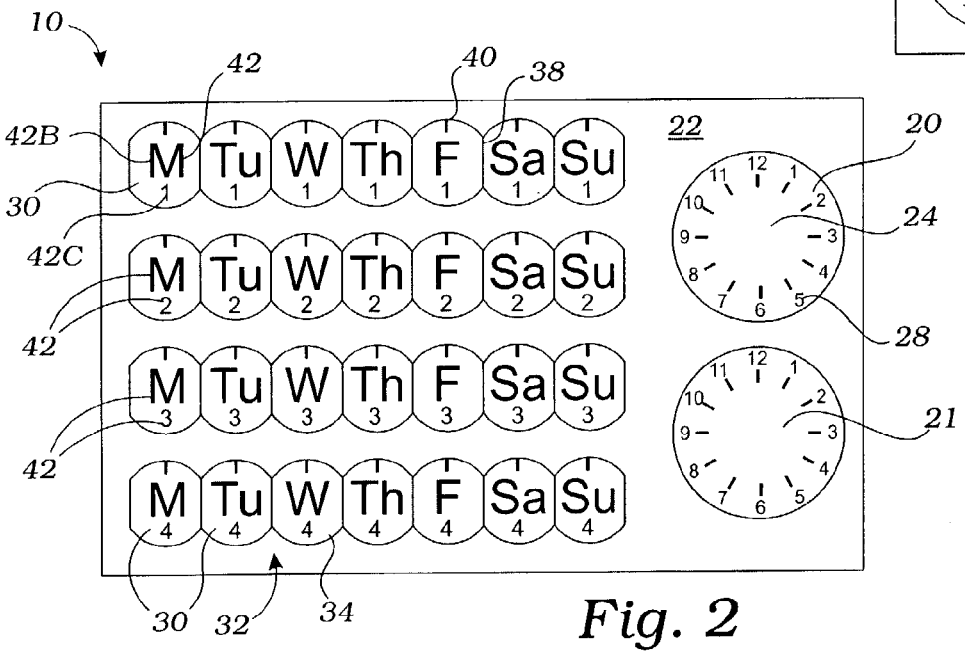
FIG. 2 is a top plan view of a second embodiment thereof.

As shown in FIGS. 1–3, the time indicating sheet 20 has a top surface 24 that is imprinted with a plurality of time indicating indicia 28. The plurality of time indicating indicia 28 are spatially separated from each other on the top surface 24 and are each adapted to indicate a time period. The plurality of time indicating indicia 28 may be printed, etched, embosses, or otherwise formed or marked on the time indicating sheet 20. The time indicating indicia 28 are preferably printed on the top surface 24 using techniques well known in the art. In one embodiment, the plurality of time indicating indicia 28 are printed with glow-in-the-dark ink to facilitate finding the container 12 and using the tracking device 10 in the dark. The time indicating indicia 28 preferably include marks that imitate the face of a clock, preferably numbered from 1–12 in the same manner as a clock, although other marks may be used, such as roman numerals, or simply the numbers 3, 6, 9, and 12, along with marks to indicate the other numbers. In an alternative embodiment, as shown in FIG. 3, the plurality of time indicating indicia 28 includes printed days of the week, which may be subdivided further into A.M. and P.M., or other subdivisions (such as morning, noon, and night). Any arrangement of marks that indicate some measure of time should be considered to be within the scope of the term "time indicating indicia 28," and within the scope of the claimed invention.

As shown in FIGS. 1–2, the time indicating sheet 20 may be a generally disk shaped sheet made of paper, plastic, or similar material. In an alternative embodiment, as shown in FIG. 7, the time indicating sheet 20 is ring shaped. In another alternative embodiment, as shown in FIG. 9, the time indicating sheet 20 is square. In another embodiment, not shown, the time indicating sheet 20 is integrally molded as part of the container 12 and the plurality of time indicating indicia 28 are formed as part of the injection molding process. Obviously, alternative shapes can be used without altering the nature of the invention.

Figure 3A:
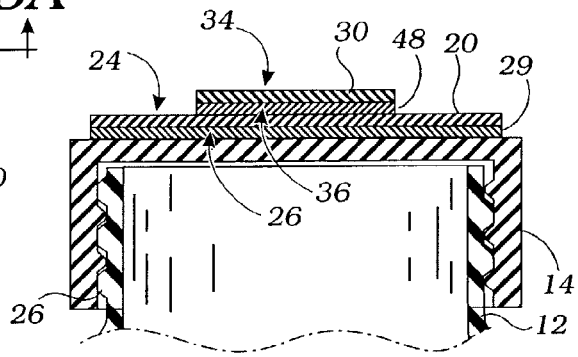
FIG. 3A is a sectional view thereof taken along line 3A—3A in FIG. 3.

The time indicating sheet 20 includes a means for associating the time indicating sheet 20 with the container 12. As shown in FIG. 3A, in the preferred embodiment, the means for associating is an adhesive layer 29 disposed on a bottom surface 26 of the time indicating sheet 20. The adhesive layer 29 may be used to directly adhere the time indicating sheet 20 onto the container 12. The adhesive layer 29 may be a relatively strong adhesive, so that the time indicating sheet 20 does not inadvertently fall off the container 12, or it may be a weaker adhesive that allows the time indicating sheet 20 to be removed if desired.

Those skilled in the art can devise many similar means for associating or attaching the time indicating sheet 20 with the container 12, and these similar or equivalent methods should be considered within the scope of the claimed invention. For example, a rubber band (not shown) or similar strand could be used to attach the time indicating sheet 20 to the container 12; or a double sided tape (not shown) could be used to make the attachment. Furthermore, the time indicating sheet 20 could be stapled to a paper bag used to store the container 12. The scope of the means for associating should not be limited to these examples, but these examples should be viewed as illustrative of some of the alternatives that are available.

In the use of the preferred embodiment, the time indicating sheet 20 is peeled from the release liner 22 and attached to the container 12, as shown in FIG. 7, preferably to the lid 14 of the container 12, to avoid covering any important information that may be printed on a side 16 of the container 12. However, in an alternative embodiment, as shown in FIG. 9, the time indicating sheet 20 may be attached to the side 16 of the container 12.

Figure 3B:
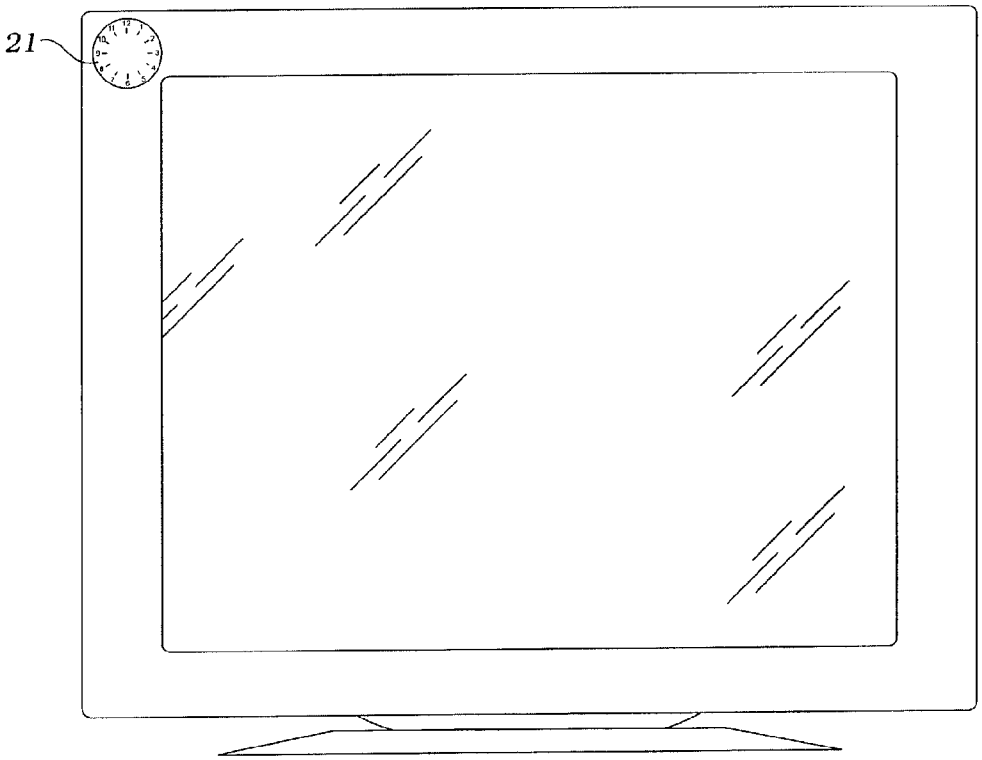
FIG. 3B is a front elevational view of a computer bearing a second time indicating sheet for purposes of reminding a user to take one of the plurality of doses.
Figure 4:
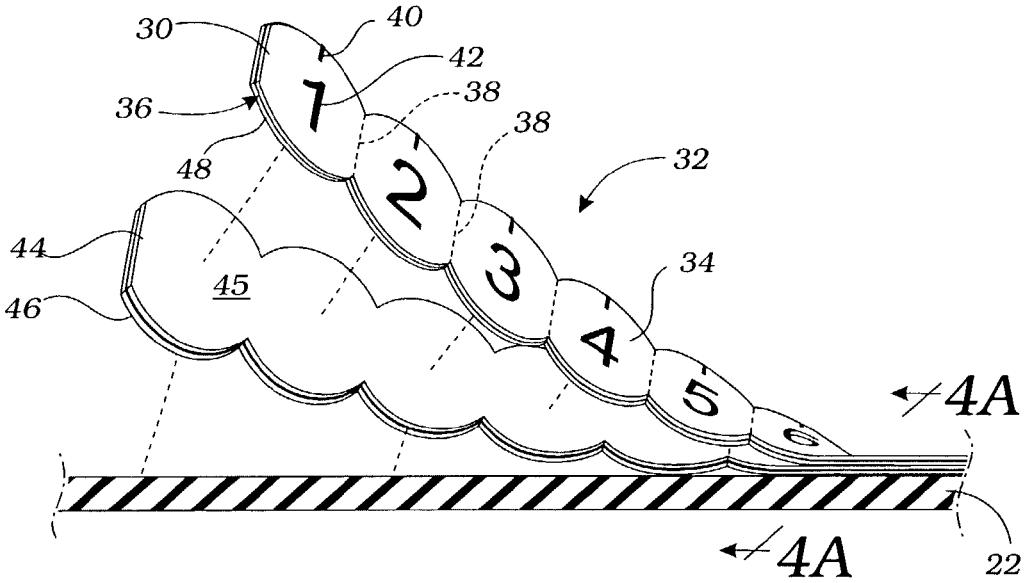
FIG. 4 is a perspective view of a first embodiment of the ingestion tracking strip.
Figure 4A:
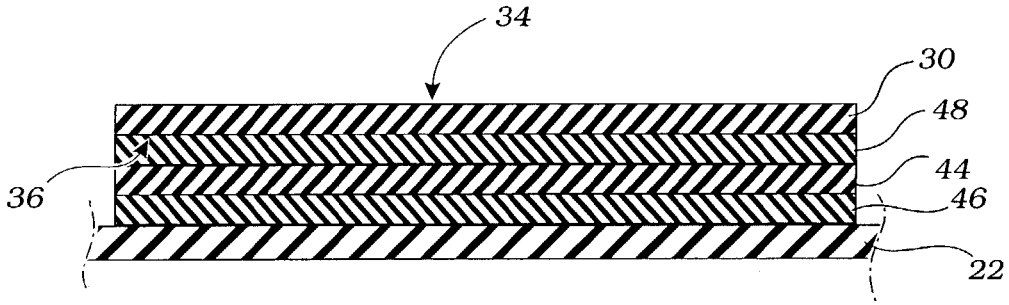
FIG. 4A is a sectional view thereof taken along line 4A—4A in FIG. 4.

It is also desirable to include a second time indicating sheet 21 on the release liner 22. The second time indicating sheet 21 can be used as a replacement for the time indicating sheet 20; or it may be used to remind the user to take his or her medication. In one example, as shown in FIG. 3B, the second time indicating sheet 21 may be adhered to a surface such as a computer monitor, a television, or the like. When the user sees the second time indicating sheet 21 during the ordinary course of the day, he or she is reminded to take the medication.

A plurality of dose indicators 30 are used to represent each of the plurality of doses that are to be ingested during a given period of time. The plurality of dose indicators 30 each include a means for visibly indicating a direction of orientation. In a preferred embodiment, as shown in FIGS. 1–2, the plurality of dose indicators 30 each include an upper surface 34 and the means for visibly indicating a direction of orientation is a reference mark 40 that is printed, marked, embossed, or otherwise formed upon the upper surface 34. In alternative embodiments, the means for visibly indicating a direction of orientation is provided by a reference shape 41 of each of the plurality of dose indicators 30, such as an arrow shape as shown in FIG. 9, or an alternative shape such as an extended portion (not shown), a notch (not shown), or other shape that can be used to indicate direction. These and alternative structures should be considered within the scope of the claimed invention.

Figure 5:
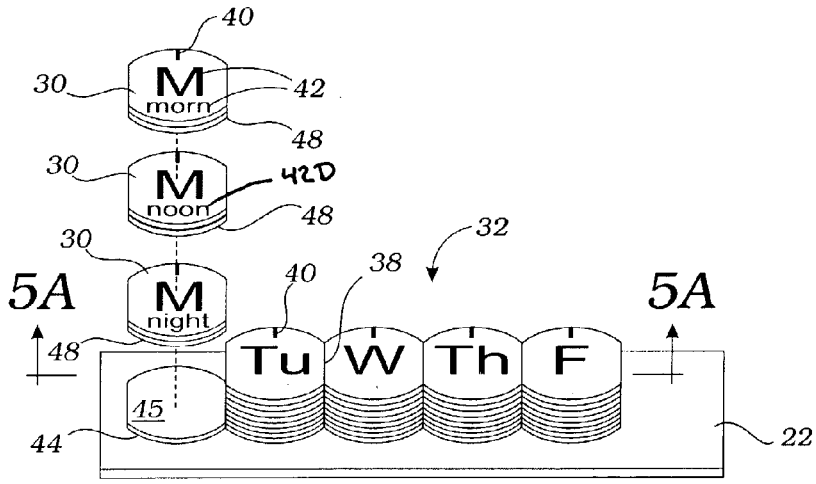
FIG. 5 is a perspective view of a second embodiment of the ingestion tracking strip.

Each of the plurality of dose indicators 30 also includes one of a plurality of dose identifying indicia 42 that is used to reference which of the plurality of doses is being consumed. Each of the plurality of dose identifying indicia 42 may be printed, marked, embossed, or otherwise formed upon the upper surface 34 of one of the plurality of dose indicators 30. In one embodiment, as shown in FIG. 1, the plurality of dose identifying indicia 42 include sequential alphanumeric characters 42A such as numbers, letters, or other characters that indicate order. In another embodiment, as shown in FIG. 2, the plurality of dose identifying indicia 42 include days of the week 42B, or other references to time; and also include dose numbers 42C within that particular day. As shown in FIG. 5, the days of the week 42B may be subdivided into periods of the day 43D such as morning, noon, and night (or AM and PM, as shown in FIG. 6).

The plurality of dose indicators 30 further include a means for attaching each of the plurality of dose indicators 30, in turn, to the top surface 24 of the time indicating sheet 20 such that the means for visibly indicating a direction of orientation is associated with one of the plurality of time indicating indicia 28. In the preferred embodiment, the means for attaching is a layer of adhesive 48 disposed on a lower surface 36 of each of the plurality of dose indicators 30. Alternative means for attaching, not shown, may include double-sided tape, pins, frictional engagement with a slot or other structure, or some other similar or equivalent form of attachment known in the art.

In a preferred embodiment, the plurality of dose indicators 30 are provided in the form of an ingestion tracking strip 32 illustrated in FIGS. 1, 2, 4, and 7 (alternative embodiments of the ingestion tracking strip 32 are shown in FIGS. 5, 5A, 6, and 6A). The ingestion tracking strip 32 includes a plurality of weakened portions 38 through the ingestion tracking strip 32 that function to separate the ingestion tracking strip 32 into the plurality of dose indicators 30.

As shown in FIGS. 1, 2, and 4–7, the ingestion tracking strip 32 includes a means for removably associating the ingestion tracking strip 32 with the container 12. The means for removably associating is preferably a release layer 44 that is preferably shaped to generally conform to the ingestion tracking strip 32, although this is not required. The release layer 44 includes a second layer of adhesive 46 that functions to bond the release layer 44 to the container 12, either fixedly or removably, depending upon the tack of the adhesive used. The release layer 44 further includes a waxy surface 45 (shown in FIG. 4) to which the layer of adhesive 48 of the plurality of dose indicators 30 may be removably attached.

As shown in FIGS. 1–2, 4, and 4A, the ingestion tracking strip 32 is initially bonded to the release liner 22. The user then peels the ingestion tracking strip 32 from the release liner 22 and uses the second layer of adhesive 46 to bond the ingestion tracking strip 32 to the container 12, as shown in FIG. 7. The user can then peel each of the plurality of dose indicators 30 from the release layer 44, tear the next of the plurality of weakened portions 38, and attach the removed one of the plurality of dose indicators 30 to the time indicating sheet 20, as shown in FIGS. 8–9.

Those skilled in the art can devise many similar means for removably associating or attaching the plurality of dose indicators 30 with the container 12, and these similar or equivalent methods should be considered within the scope of the claimed invention. For example, a rubber band (not shown) or similar strand could be used to attach the plurality of dose indicators 30 to the container 12; or a double sided tape with a low tack adhesive (not shown) could be used to make the removably attachment. Furthermore, the plurality of dose indicators 30 could be removably attached to an intermediary (not shown) which is fastened to the container 12 or stapled to a paper bag (not shown) used to store the container 12. The scope of the means for removably associating should not be limited to these examples, but these examples should be viewed as illustrative of some of the alternatives that are available.

Figure 5A:
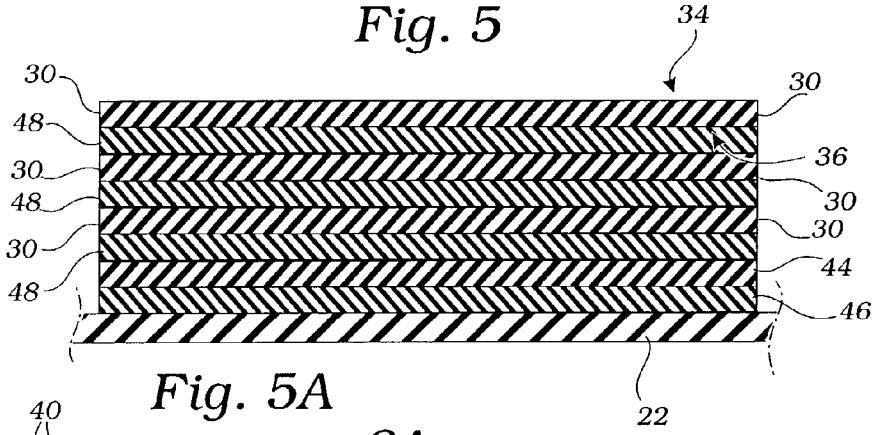
FIG. 5A is a sectional view thereof taken along line 5A—5A in FIG. 5.

In an alternative embodiment, as shown in FIGS. 5 and 5A, several of the plurality of dose indicators 30 are stacked on one another using the layer of adhesive 48, in this case a low tack adhesive that allows them to removed from each other without harming the upper surface 34 of the dose indicator 30 on which it was mounted. This arrangement is particularly useful when each stack is associated with each other, for example, when the plurality of dose indicating indicia include a day of the week 42B and a period of the day 42D (or a dose number 42C, as shown in FIG. 2).

The invention includes a method for tracking the ingestion of a plurality of doses of an ingestible material from a container 12 using the tracking device 10 described above. The time indicating sheet 20 is associated with the container, preferably by peeling it from the release liner 22 and attaching it to the container 12 with the adhesive layer 29. The time indicating sheet 20 is preferably shaped to fit on the lid 14 of the container 12, as shown in FIGS. 3, 3A, 7, and 8; however, in an alternative embodiment, the time indicating sheet 20 is sized and shaped to be attached to the side 16 of the container 12.

Over a series of time intervals, the user ingests each of the plurality of doses of the ingestible material from the container 12. Every time a dose is ingested, the user attaches one of the plurality of dose indicators 30 to the top surface 24 of the time indicating sheet 20 such that the means for visibly indicating a direction of orientation indicates a direction of orientation that is associated with one of the plurality of time indicating indicia 28. For example, when the user takes the first of the plurality of doses at 12:00 pm, the user also attaches the first of the plurality of dose indicators 30 to the time indicating sheet 20 such that the reference mark 40 points to the time indicating indicia 28 that represents this time, in this case a 12 marked at the top of the clock-face shaped time indicating sheet 20. Then, when the user takes the second of the plurality of doses at 3:00 pm, the user also attaches the second of the plurality of dose indicators 30 to the time indicating sheet 20, as shown in FIG. 8, such that the reference mark 40 points to the time indicating indicia that represents this time, in this case a 3 marked at the right side of the clock-face shaped time indicating sheet 20.

The invention should not be limited to the specific embodiments described herein, but should be construed to include alternative embodiments that can be devised by those skilled in the art. For example, the invention could be used to track any number of processes, and should not be limited to the first embodiment of tracking doses of medication. An industrial process, for example, could be tracked in the same manner; and other processes or jobs could also be tracked, such as when a vat of cooking oil has been changed, or when a bathroom has been cleaned. Different colors of the plurality of dose indicators 30 could be used to indicate which worker performed the task, thereby providing a means of tracking job completion in a routine and systematic fashion.

While the invention has been described with reference to at least one preferred embodiment, it is to be clearly understood by those skilled in the art that the invention is not limited thereto. Rather, the scope of the invention is to be interpreted only in conjunction with the appended claims.

All patents, patent applications, and other documents and printed matter cited or referred to in this application is hereby incorporated by reference in full.

What is claimed is:

1. A tracking device for tracking the ingestion of a plurality of doses of an ingestible material from a container, the tracking device comprising:

a time indicating sheet having a top surface;

a plurality of time indicating indicia imprinted on the top surface, each of the plurality of time indicating indicia being spatially separated from each other on the top surface and being adapted to indicate a time period;

a plurality of dose indicators, each of the plurality of dose indicators having one of a plurality of dose identifying indicia;

a means for visibly indicating a direction of orientation visible on each of the plurality of dose indicators; and a means for attaching each of the plurality of dose indicators, in turn, to the top surface of the time indicating sheet such that the means for visibly indicating a direction of orientation visibly indicates a direction of orientation that is associated with one of the plurality of time indicating indicia.

2. The tracking device of claim 1 wherein the means for visibly indicating a direction of orientation is a reference mark on the upper surface.

3. The tracking device of claim 1 wherein the means for visibly indicating a direction of orientation is a reference shape.

4. The tracking device of claim 1 wherein the means for attaching each of the plurality of dose indicators is a layer of adhesive disposed on a lower surface of the plurality of dose indicators.

5. A tracking device for tracking the ingestion of a plurality of doses of an ingestible material from a container, the tracking device comprising:

a time indicating sheet having a top surface;

a plurality of time indicating indicia imprinted on the top surface, each of the plurality of time indicating indicia being spatially separated from each other on the top surface and being adapted to indicate a time period;

a means for associating the time indicating sheet with the container of the ingestible material;

an ingestion tracking strip having an upper surface and a lower surface;

a plurality of weakened portions through the ingestion tracking strip that function to separate the ingestion tracking strip into a plurality of dose indicators;

a means for visibly indicating a direction of orientation visible on each of the plurality of dose indicators;

a plurality of dose identifying indicia, each of the plurality of dose identifying indicia being imprinted upon one of the plurality of dose indicators;

a means for removably associating the ingestion tracking strip with the container; and a means for attaching each of the plurality of dose indicators, in turn, to the top surface of the time indicating sheet such that the means for visibly indicating a direction a direction of orientation visibly indicates a direction of orientation that is associated with one of the plurality of time indicating indicia.

6. The tracking device of claim 5 wherein the means for visibly indicating a direction of orientation is a reference mark on the upper surface.

7. The tracking device of claim 5 wherein the means for visibly indicating a direction of orientation is a reference shape.

8. The tracking device of claim 5 wherein the means for attaching each of the plurality of dose indicators is a layer of adhesive disposed on a lower surface of the plurality of dose indicators.

9. The tracking device of claim 5 wherein the means for associating the time indicating sheet with the container of the ingestible material is an adhesive layer disposed on a bottom surface of the time indicating sheet.

10. A method for tracking the ingestion of a plurality of doses of an ingestible material from a container, the method comprising the steps of:

a) providing a tracking device comprising:

a. time indicating sheet having a top surface;

a plurality of time indicating indicia imprinted on the top surface, each of the plurality of time indicating indicia being spatially separated from each other on the top surface and being adapted to indicate a time period;

a plurality of dose indicators, each of the plurality of dose indicators having one of a plurality of dose identifying indicia; and a means for visibly indicating a direction of orientation;

b) attaching the time indicating sheet to the container; and c) attaching one of the plurality of dose indicators, following the ingestion of each of the plurality of doses, to the top surface of the time indicating sheet such that the means for visibly indicating a direction of orientation visibly indicates a direction of orientation that is associated with one of the plurality of time indicating indicia.

11. The method of claim 10 wherein the means for visibly indicating a direction of orientation is a reference mark on the upper surface.

12. The method of claim 10 wherein the means for visibly indicating a direction of orientation is a reference shape.

13. The method of claim 10 wherein the plurality of dose indicators are attached to the top surface with a layer of adhesive disposed on a lower surface of the plurality of dose indicators.

* * * * *